US010021759B2

(12) United States Patent
Qi et al.

(10) Patent No.: US 10,021,759 B2
(45) Date of Patent: Jul. 10, 2018

(54) PIXEL UNIT DRIVING CIRCUIT AND DRIVING METHOD, AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Xiaojing Qi, Beijing (CN); Bo Wu, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 202 days.

(21) Appl. No.: 13/805,483

(22) PCT Filed: Oct. 24, 2012

(86) PCT No.: PCT/CN2012/083429
§ 371 (c)(1),
(2) Date: Dec. 19, 2012

(87) PCT Pub. No.: WO2013/064028
PCT Pub. Date: May 10, 2013

(65) Prior Publication Data

US 2014/0084806 A1 Mar. 27, 2014

(30) Foreign Application Priority Data

Oct. 31, 2011 (CN) ..... 2011 1 0338642

(51) Int. Cl.
*G09G 3/32* (2016.01)
*H05B 33/08* (2006.01)
(Continued)

(52) U.S. Cl.
CPC ..... *H05B 33/0896* (2013.01); *G09G 3/3225* (2013.01); *G09G 3/3233* (2013.01);
(Continued)

(58) Field of Classification Search
CPC ..... G09G 3/32; G09G 3/3225; G09G 3/3233; G09G 2300/0852; G09G 2320/0233;
(Continued)

(56) References Cited

U.S. PATENT DOCUMENTS

2005/0052377 A1 3/2005 Hsueh
2005/0110730 A1* 5/2005 Kim ..... G09G 3/3233 345/82
(Continued)

FOREIGN PATENT DOCUMENTS

CN 1917016 A 2/2007
CN 101996579 A 3/2011
(Continued)

OTHER PUBLICATIONS

International Preliminary Report on Patentability dated May 6, 2014; PCT/CN2012/083429.
(Continued)

*Primary Examiner* — Richard Hong
(74) *Attorney, Agent, or Firm* — Ladas & Parry LLP; Loren K. Thompson

(57) ABSTRACT

The present disclosure discloses a pixel unit driving circuit, a driving method, and a display apparatus, wherein the pixel unit driving circuit includes a light-emitting device, a driving transistor, a first switching transistor, a second switching transistor, a third switching transistor, a fourth switching transistor, a first capacitor, and a second capacitor. The pixel unit driving circuit is driven in a stepwise manner by the turn-on/off of the switching transistors in cooperation with the charging of the capacitors, so that a driving current of the
(Continued)

driving transistor has no relation to the turn-on voltage $V_{th}$ of the driving transistor, and in turn the evenness of a current flowing through the light-emitting device is guaranteed so as to achieve the evenness of the luminance of the light-emitting device.

9 Claims, 5 Drawing Sheets

(51) Int. Cl.
*G09G 3/3225* (2016.01)
*G09G 3/3233* (2016.01)

(52) U.S. Cl.
CPC ..... *G09G 2300/0819* (2013.01); *G09G 2300/0852* (2013.01); *G09G 2300/0861* (2013.01); *G09G 2320/0233* (2013.01); *G09G 2320/045* (2013.01)

(58) Field of Classification Search
CPC ... G09G 2300/0819; G09G 2300/0861; G09G 2320/045; H05B 33/0896; Y02B 20/343; Y02B 20/346; Y02B 20/36
See application file for complete search history.

(56) References Cited

U.S. PATENT DOCUMENTS

| | | | | |
|---|---|---|---|---|
| 2007/0040786 | A1 | 2/2007 | Chung | |
| 2007/0273618 | A1 | 11/2007 | Hsieh et al. | |
| 2008/0158205 | A1* | 7/2008 | Park | G09G 3/3225 345/204 |
| 2009/0027312 | A1* | 1/2009 | Han et al. | 345/76 |
| 2010/0109717 | A1* | 5/2010 | Lin | G09G 3/3233 327/109 |
| 2010/0220038 | A1 | 9/2010 | Chung et al. | |
| 2011/0227893 | A1 | 9/2011 | Bae et al. | |

FOREIGN PATENT DOCUMENTS

| | | | |
|---|---|---|---|
| CN | 102194404 | A | 9/2011 |
| CN | 102654974 | A | 9/2012 |
| JP | 2006-343762 | A | 12/2006 |
| JP | 2007-179030 | A | 7/2007 |
| JP | 2007-316639 | A | 12/2007 |
| JP | 2008-191450 | A | 8/2008 |
| JP | 2009-025821 | A | 2/2009 |
| KR | 20040008684 | A | 1/2004 |
| KR | 20080030135 | A | 4/2008 |
| KR | 20090010371 | A | 1/2009 |

OTHER PUBLICATIONS

International Search Report dated Jan. 31, 2013; PCT/CN2012/083429.
First Chinese Office Action dated Dec. 20, 2013; Appln. No. 201110338642.9.
Korea Non-Final Rejection Office Action dated Dec. 30, 2013; Appln. No. 10-2012-7032527.
Third Chinese Office Action Appln. No. 201110338642.9; Dated Nov. 15, 2014.
Second Chinese Office Action dated Aug. 8, 2014; Appln. No. 201110338642.9.
Japanese Office Action dated May 9, 2016; Appln. No. 2014-537476.
Final Japanese Office Action dated Nov. 21, 2016; Appln. No. JP2014-537476.

* cited by examiner

②

③

PIXEL UNIT DRIVING CIRCUIT AND DRIVING METHOD, AND DISPLAY APPARATUS

TECHNICAL FIELD OF THE DISCLOSURE

The present disclosure relates to displaying technology, and particularly to a pixel unit driving circuit and driving method, and a display apparatus.

BACKGROUND

With the development of science technology, the technology of electronic displaying upgrades steadily. Organic Light-Emitting Diode (OLED), as a new generation of display device, has the advantages of thin and light, high contrast, rapid response, etc, and is widely used in the electronic devices such as mobile phones, notebook computers, Wall-mounted television set, etc. OLED can be divided, according to its driving mode, into two types, i.e., Passive Matrix Driving OLED (PMOLED) and Active Matrix Driving OLED (AMOLED). The Active Matrix Driving mode has been widely used in the display for a large amount of information due to its capability of high display quality.

A traditional pixel unit driving circuit of AMOLED is shown in FIG. 1, and includes a switching transistor T, a driving transistor DTFT, OLED and a capacitor C. In FIG. 1, a gate of the switching transistor T is connected to a scanning line, a drain of the switching transistor T is connected to a data line, a source of the switching transistor T is connected to a gate of the driving transistor. A drain of the driving transistor DTFT is connected to a power supply VDD, a source of the driving transistor DTFT is connected to ground via OLED. The capacitor C is connected between the gate and the drain of the driving transistor DTFT. In this traditional pixel unit driving circuit, current flowing through OLED relates to the turn-on voltage $V_{th}$ of the driving transistor DTFT.

AMOLED emits light due to a driving current generated by the driving transistor DTFT in a saturation stage. During the manufacturing procedure of Low Temperature Polysilicon (LTPS), the evenness of the turn-on voltage $V_{th}$ of the driving transistor DTFT is terribly bad and meanwhile the turn-on voltage $V_{th}$ may drift. In the driving circuit shown in FIG. 1, different driving currents will be generated due to different turn-on voltages when the same voltage for a certain grey scale is input, which causes the inconsistency of the driving currents, that is, the unevenness of the current flowing through OLED and in turn the unevenness of the luminance of OLED.

SUMMARY

Embodiments of the present disclosure provides a pixel unit driving circuit and driving method and a display apparatus capable of making current flowing through a light-emitting device even and in turn making luminance of the light-emitting device even.

An embodiment of the present disclosure provides a pixel unit driving circuit, including a light-emitting device, a driving transistor, a first switching transistor, a second switching transistor, a third switching transistor, a fourth switching transistor, a first capacitor, and a second capacitor, wherein, the driving transistor includes a source, a drain and a gate, all of the first switching transistor, the second switching transistor, the third switching transistor include a gate, a first terminal and a second terminal, the fourth switching transistor includes a source, a drain and a gate;

the drain of the driving transistor is connected to a power supply;

the gate of the first switching transistor is connected to a control line, the first terminal of the first switching transistor is connected to the power supply, and the second terminal of the first switching transistor is connected to the gate of the driving transistor;

the gate of the second switching transistor is connected to the control line, the first terminal of the second switching transistor is connected to the source of the driving transistor, and the second terminal of the second switching transistor is connected to the source of the fourth switching transistor;

the gate of the third switching transistor is connected to the control line, the first terminal of the third switching transistor is connected to one terminal of the light-emitting device, and the second terminal of the third switching transistor is connected to the source of the driving transistor;

the gate of the fourth switching transistor is connected to a scan line, the drain of the fourth switching transistor is connected to a data line, and the source of the fourth switching transistor is connected to the second terminal of the second switching transistor;

one terminal of the first capacitor is connected to the gate of the driving transistor, and the other terminal of the first capacitor is connected to the source of the fourth switching transistor; and one terminal of the second capacitor is connected to the source of the fourth switching transistor, and the other terminal of the second capacitor is connected to the other terminal of the light-emitting device and to ground.

Another embodiment of the present disclosure also provides a pixel unit driving method, including the steps of:

turning on the first switching transistor and the second switching transistor, and meanwhile turning off the third switching transistor and the fourth switching transistor, so as to charge the first capacitor;

turning off the first switching transistor and the second switching transistor, and meanwhile turning on the third switching transistor and the fourth switching transistor, so as to make the light-emitting device start to emit light, when a voltage between the two terminals of the first capacitor is equal to the turn-on voltage of the driving transistor;

maintaining the first switching transistor and the second switching transistor being off and the third switching transistor being on, and turning off the fourth switching transistor, so as to maintain the light-emitting device in light-emitting.

In an example, the driving transistor, the third switching transistor and the fourth switching transistor are N-type Thin Film Transistors; the first switching transistor and the second switching transistor are P-type Thin Film Transistors; and the first terminal of each switching transistor is a source and the second terminal of each switching transistor is a drain.

In an example, the step of turning on the first switching transistor and the second switching transistor and meanwhile turning off the third switching transistor and the fourth switching transistor includes inputting a low level through the control line and a low level through the scan line; the step of turning off the first switching transistor and the second switching transistor and meanwhile turning on the third switching transistor and the fourth switching transistor includes inputting a high level through the control line and a high level through the scan line; and the step of maintaining the first switching transistor and the second switching transistor being off and the third switching transistor being on and turning off the fourth switching transistor includes inputting a high level through the control line and a low level through the scan line.

In an example, the driving transistor, the first switching transistor, the second switching transistor and the fourth switching transistor are N-type Thin Film Transistors; the third switching transistor is a P-type Thin Film Transistor; and the first terminal of each switching transistor is a drain and the second terminal of each switching transistor is a source.

In an example, the step of turning on the first switching transistor and the second switching transistor and meanwhile turning off the third switching transistor and the fourth switching transistor includes inputting a high level through the control line and a low level through the scan line; the step of turning off the first switching transistor and the second switching transistor and meanwhile turning on the third switching transistor and the fourth switching transistor includes inputting a low level through the control line and a high level through the scan line; and the step of maintaining the first switching transistor and the second switching transistor being off and the third switching transistor being on and turning off the fourth switching transistor includes inputting a low level through the control line and a low level through the scan line.

In the pixel unit driving circuit and driving method and the display apparatus according to the embodiments of the present disclosure, the pixel unit driving circuit adopts a plurality of switching transistors and a plurality of capacitors. The pixel unit driving circuit is driven in a stepwise manner by the turn-on/off of the switching transistors in cooperation with the charging of the capacitors, so that a driving current of the driving transistor has no relation to the turn-on voltage $V_{th}$ of the driving transistor, and in turn the evenness of a current flowing through the light-emitting device is guaranteed so as to achieve the evenness of the luminance of the light-emitting device.

BRIEF DESCRIPTION OF THE DRAWINGS

In order to more clearly describe the technical solutions of the embodiments of the present disclosure or the prior art, drawings necessary for describing the embodiments of the present disclosure or the prior art are simply introduced as follows. It should be obvious for those skilled in the art that the drawings described as follows are only some embodiments of the present disclosure and other drawings can be obtained according to these drawings without paying inventive efforts.

DETAILED DESCRIPTION

The technical solutions of embodiments of the present disclosure will be described clearly and thoroughly below in connection with drawings of the embodiments of the present disclosure. It should be obvious for those skilled in the art that the embodiments described below are only a part of embodiments of the present disclosure rather than all of the embodiments of the present disclosures. On the basis of the embodiments of the present application, all other embodiments obtained by those skilled in the art without paying inventive efforts should be considered as belonging to the scope claimed by the present disclosure.

Figure 1:
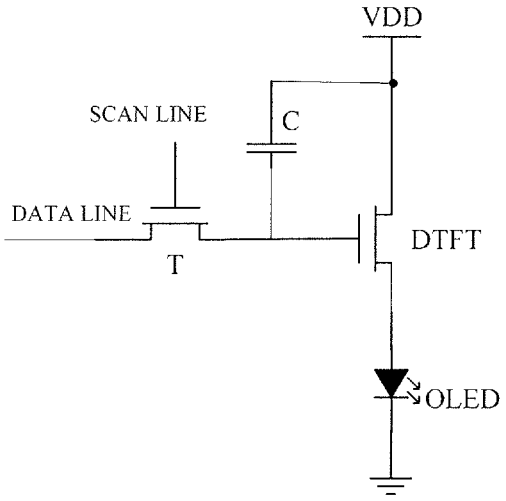
FIG. 1 is a schematic structural diagram of a pixel unit driving circuit in the prior art.
Figure 2:
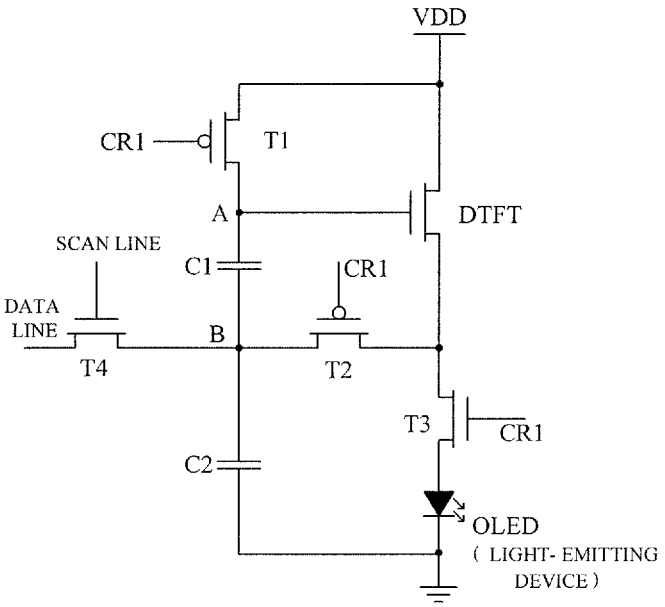
FIG. 2 is a schematic structural diagram of a pixel unit driving circuit provided in embodiments of the present disclosure.

FIG. 2 is a schematic structural diagram of a pixel unit driving circuit provided in embodiments of the present disclosure. As shown in FIG. 2, the pixel unit driving circuit includes a light-emitting device OLED, a driving transistor DTFT, a first switching transistor T1, a second switching transistor T2, a third switching transistor T3, a fourth switching transistor T4, a first capacitor C1 and a second capacitor C2.

It should be clear that the term of "switching transistor" refers to a Thin Film Transistor functioning as a switch and the term of "driving transistor" refers to a Thin Film Transistor for driving the light-emitting device to emit light.

In this embodiment, the first switching transistor T1 and the second switching transistor T2 are P-type Thin Film Transistors, a third switching transistor T3, the fourth switching transistor T4 and the driving transistor DTFT are N-type Thin Film Transistors. Each of the driving transistor DTFT and the respective switching transistors includes a source, a drain and a gate.

As shown in FIG. 2, the driving transistor DTFT drives the light-emitting device OLED to emit light, and the drain of the driving transistor DTFT is connected to a power supply VDD.

The gate of the first switching transistor T1 is connected to a control line CR1, the source (a first terminal) of the first switching transistor T1 is connected to the power supply VDD, and the drain (a second terminal) of the first switching transistor T1 is connected to the gate of the driving transistor DTFT.

The gate of the second switching transistor T2 is connected to the control line CR1, the source of (a first terminal) of the second switching transistor T2 is connected to the source of the driving transistor DTFT, and the drain (a second terminal) of the second switching transistor T2 is connected to the source of the fourth switching transistor T4.

The gate of the third switching transistor T3 is connected to the control line CR1, the source (a first terminal) of the third switching transistor T3 is connected to one terminal of the light-emitting device OLED, and the drain (a second terminal) of the third switching transistor T3 is connected to the source of the driving transistor DTFT.

The gate of the fourth switching transistor T4 is connected to a scan line, the drain of the fourth switching transistor T4 is connected to a data line, and the source of the fourth switching transistor T4 is connected to the drain of the second switching transistor T2.

A terminal "A" of the first capacitor C1 is connected to the gate of the driving transistor DTFT, that is, to the drain of the first switching transistor T1, and a terminal "B" of the first capacitor C1 is connected to the source of the fourth switching transistor T4, that is, to the drain of the second switching transistor T2.

One terminal of the second capacitor C2 is connected to the source of the fourth switching transistor T4, that is, to the terminal "B" of the first capacitor C1 and to the drain of the second switching transistor T2, and the other terminal of the second capacitor C2 is connected to the other terminal of the light-emitting device OLED and to ground.

Below detailed description will be given to the driving method of the pixel unit driving circuit shown in FIG. 2 in connection with FIGS. 3-6.

Figure 3:
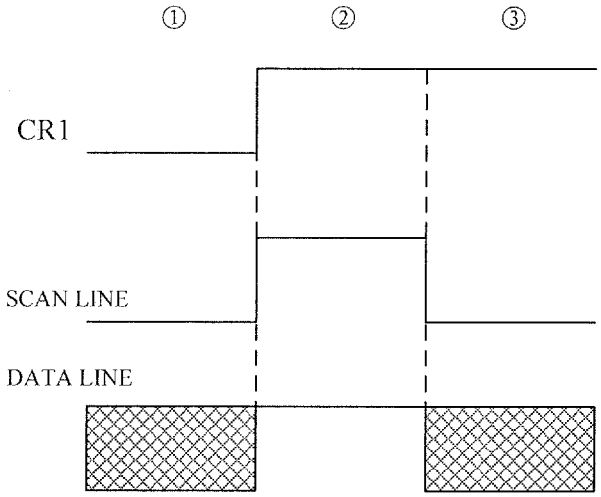
FIG. 3 is a timing sequence diagram of respective signal lines when driving the pixel unit driving circuit shown in FIG. 2.

When driving OLED, the procedure for driving the pixel unit driving circuit shown in FIG. 2 can be divided into three driving stages: a compensation stage, a stage in which OLED starts to emit light, and a stage in which OLED maintains to emit light. FIG. 3 is a timing sequence diagram of respective signal lines when driving the pixel unit driving circuit as shown in FIG. 2. As shown in FIG. 3, ①, ② and ③ are used to represent the compensation stage, the stage in which OLED starts to emit light, and the stage in which OLED maintains to emit light, respectively. The driving method for the pixel unit driving circuit shown in FIG. 2 are as follows:

a first stage: the compensation stage during which the first switching transistor T1 and the second switching transistor T2 turn on, and meanwhile the third switching transistor T3 and the fourth switching transistor T4 turn off, so as to charge the first capacitor C1, and thus the pixel unit driving circuit shown in FIG. 2 comes into the first stage.

Figure 4:
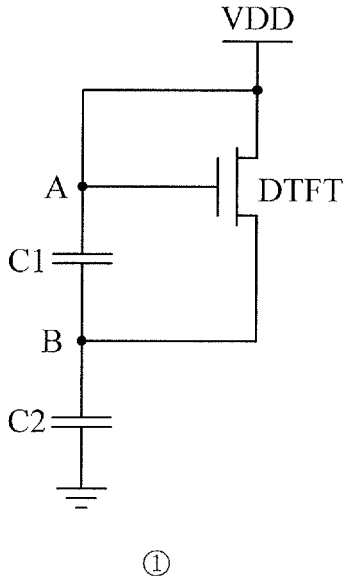
FIG. 4 is a schematic equivalent circuit diagram of the pixel unit driving circuit shown in FIG. 2 during a compensation stage.

The purpose of the stage is writing the turn-on voltage $V_{th}$ of the driving transistor DTFT into the first capacitor C1 to make a voltage across the two terminals of the first capacitor C1 equal to the turn-on voltage $V_{th}$ of the driving transistor DTFT. During this stage, the first switching transistor T1 and the second switching transistor T2 turn on, and meanwhile the third switching transistor T3 and the fourth switching transistor T4 turn off. In one implementation, the first switching transistor, the second switching transistor and the third switching transistor are all controlled by the control line CR1, and the fourth switching transistor is controlled by the scan line; the first switching transistor and the second switching transistor are P-type Thin Film Transistors, and the third switching transistor T3 and the fourth switching transistor T4 are N-type Thin Film Transistors. A P-type Thin Film Transistor turns on under the condition of a low level and turns off under the condition of a high level, and a N-type Thin Film Transistor turns on under the condition of a high level and turned off under the condition of a low level. Therefore, as shown by ① in FIG. 3, the control line CR1 and the scan line are at a low level, a low level is input from the control line CR1, which causes the first switching transistor T1 and the second switching transistor T2 to turn on and the third switching transistor T3 to turn off, and meanwhile a low level is input from the scan line, which causes the fourth switching transistor T4. At this time, the circuit shown in FIG. 2 actually is equivalent to the circuit shown in FIG. 4. As shown in FIG. 4, the driving transistor DTFT actually serves as a diode entering into a saturation state, during this stage, the power supply VDD charges the second capacitor C2 via the driving transistor DTFT until a gate-source voltage of the driving transistor DTFT (that is, a voltage difference between the terminal "A" and the terminal "B") becomes $V_{th}$, wherein $V_{th}$ represents the turn-on voltage of the driving transistor DTFT.

At this time, the voltage of the terminal "A" can be represented as follows:

$$V_A = VDD \tag{1}$$

Since the voltage difference between the terminal "A" and the terminal "B" is $V_{th}$, the voltage of the terminal "B" can be represented as follows:

$$V_B = VDD - V_{th} \tag{2}$$

From equations (1) and (2), the voltage across the two terminals of the first capacitor C1 can be obtained as follows:

$$V_{C1} = V_A - V_B = VDD - (VDD - V_{th}) = V_{th} \tag{3}$$

A second stage: the stage in which OLED starts to emit light. When the voltage across the two terminals of the first capacitor C1 is equal to the turn-on voltage $V_{th}$ of the driving transistor DTFT, the first switching transistor T1 and the second switching transistor T2 turn off, and meanwhile the third switching transistor T3 and the fourth switching transistor T4 turn on, so that the second capacitor C2 is charged and the light-emitting device OLED starts to emit light, and thus the circuit shown in FIG. 2 enters into the second stage.

The purpose of this stage is: writing a voltage $V_{data}$ on the data line into the second capacitor C2 and making a gate voltage of the driving transistor DTFT become $V_{data}+V_{th}$.

Figure 5:
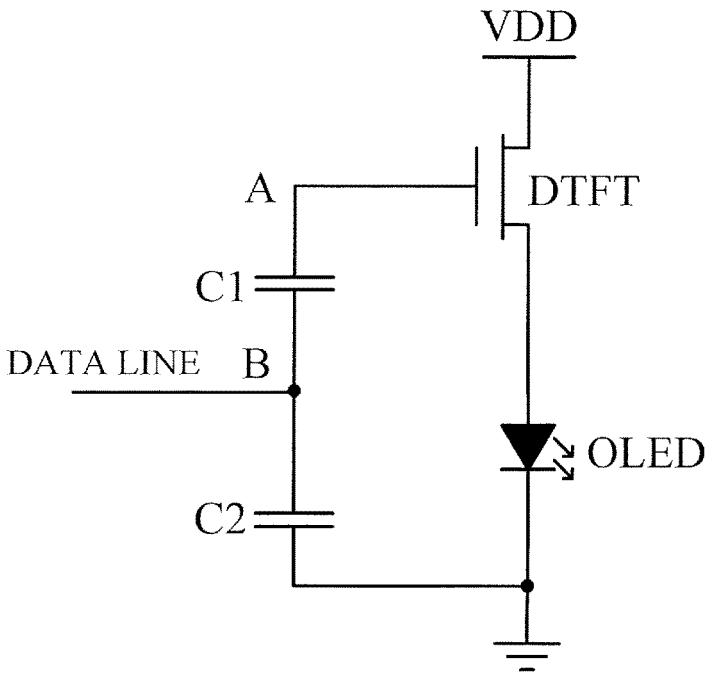
FIG. 5 is a schematic equivalent circuit diagram of the pixel unit driving circuit shown in FIG. 2 during a stage in which OLED starts to emit light.

During this stage, the first switching transistor T1 and the second switching transistor T2 turn off, and meanwhile the third switching transistor T3 and the fourth switching transistor T4 turn on. In one implementation, as shown by ② in FIG. 3, a high level is input from the control line CR1 and a high level is input from the scan line, which causes the first switching transistor T1 and the second switching transistor T2 to turn off and the third switching transistor T3 and the fourth switching transistor T4 to turn on, so that the data voltage $V_{data}$ is written into the second capacitor C2. At this time, the circuit shown in FIG. 2 is actually equivalent to the circuit shown in FIG. 5. As shown in FIG. 5, during this stage, the voltage of terminal "B" can be represented as follows: $V_B=V_{data}$, the voltage across the two terminal of the second capacitor C2 can be represented as follows: $V_{C2}=V_B=V_{data}$. Since the voltage across the two terminals of the first capacitor C1 cannot change abruptly, so the voltage of the terminal "A" can be represented as follows:

$$V_A = V_B + V_{C1} = V_{data} + V_{th} \tag{4}$$

Meanwhile, the voltage of the terminal "A" controls the driving transistor DTFT to drive the light-emitting device OLED, so that the light-emitting device OLED starts to emit light.

The gate-source voltage of the driving transistor DTFT can be obtained from the equation (4) as follows:

$$V_{gs} = V_A - V_{oled} = V_{data} + V_{th} - V_{oled} \tag{5}$$

A current flowing through OLED can be obtained from the equation (5) as follows:

$$I = K(V_{gs} - V_{th})^2 = K(V_{data} + V_{th} - V_{oled} - V_{th})^2 = K(V_{data} - V_{oled})^2 \tag{6}$$

wherein $K=\mu_{eff}*Cox*(W/L)/2$, $\mu_{eff}$ represents the effective carrier mobility, Cox represents the dielectric constant of the gate insulation layer, W/L represents the width/length ratio of the channel of the driving transistor DTFT, W represents the width of the channel, and L represents the length of the channel.

A third stage: the stage in which OLED maintains to emit light. After the second stage, that is, after the light-emitting device OLED starts to emit light, the first switching transistor. T1 and the second switching transistor T2 remain off and the third switching transistor T3 remains on, and the fourth switching transistor T4 turns off, so that the light-emitting device OLED maintains to emit light. At this time, the circuit shown in FIG. 2 enters into the third stage.

Figure 6:
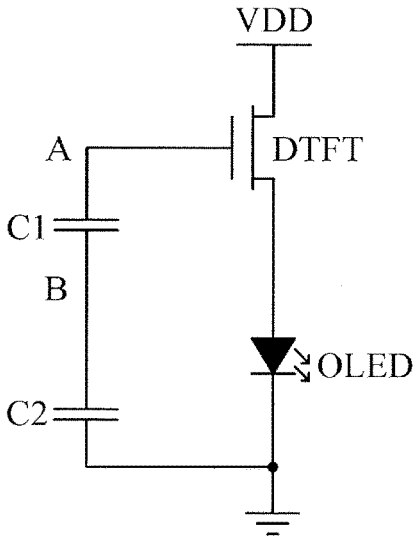
FIG. 6 is a schematic equivalent circuit diagram of the pixel unit driving circuit shown in FIG. 2 during a stage in which OLED maintains to emit light

In this stage, the first switching transistor T1 and the second switching transistor T2 remain off and the third switching transistor T3 remains on, and meanwhile the fourth switching transistor T4 turns off. In one implementation, as shown by ③ in FIG. 3, a high level is input from the control line CR1 and a low level is input from the scan line, which causes the first switching transistor T1, the second switching transistor T2 and the fourth switching transistor T4 to turn off, and the third switching transistor T3 to turn on. At this time, the circuit shown in FIG. 2 is actually equivalent to the circuit shown in FIG. 6. As shown in FIG. 6, there is no path for the first capacitor C1 and the second capacitor C2 to be charged or discharged. According to the principle of charge conservation, when there is no path for consuming charges, the charges on the first capacitor C1 and the second capacitor C2, the voltage across the two terminals of the first capacitor C1 and that across the two terminals of the second capacitor C2 remain unchanged, that is, $V_{C2}=V_{data}$, $V_{C1}=V_{th}$, $V_B=V_{data}$, $V_A=V_{data}+V_{th}$, and the voltage of the terminal "A" is unchanged, and thus the current flowing through the light-emitting device OLED remains the value of $I=K(V_{data}-V_{oled})^2$. The light-emitting device OLED maintains the light-emitting state in which the data voltage is written during the second stage.

From the equation (6), the turn-on voltage $V_{th}$ of the driving transistor DTFT does not appear in the expression of the current flowing through the light-emitting device OLED, that is, the current flowing through the light-emitting device OLED has no relation to the turn-on voltage $V_{th}$ of the driving transistor DTFT. Therefore, with the operations in the above three stages, the effect of the unevenness and drifting of the turn-on voltage $V_{th}$ of the driving transistor DTFT on the light-emitting device OLED can be removed, so that the evenness of the current can be improved and thus the evenness of the luminance can be achieved.

With the pixel unit driving circuit of the embodiment of the present disclosure in connection with the above described pixel unit driving method, the current flowing through the light-emitting device OLED has no relation to the turn-on voltage $V_{th}$ of the driving transistor DTFT, the effect of the unevenness and drifting of the turn-on voltage $V_{th}$ of the driving transistor DTFT on the current flowing through the light-emitting device OLED can be removed, so that the evenness of the current flowing through the light-emitting device OLED can be improved and thus the evenness of the luminance of the OLED can be achieved It should be clear that the pixel unit driving circuit shown in FIG. 2 is only one embodiment of the present disclosure, and other similar embodiments can be easily obtained by those skilled in the art in the light of the spirit of the present disclosure and should be considered as within the scope claimed by the present disclosure.

In an example, the light-emitting device shown in FIG. 2 can be a light-emitting Diode LED.

In an example of the above embodiment, the first switching transistor T1 and the second switching transistor T2 are P-type Thin Film Transistors, and the third switching transistor T3 is N-type Thin Film Transistor.

Figure 7:
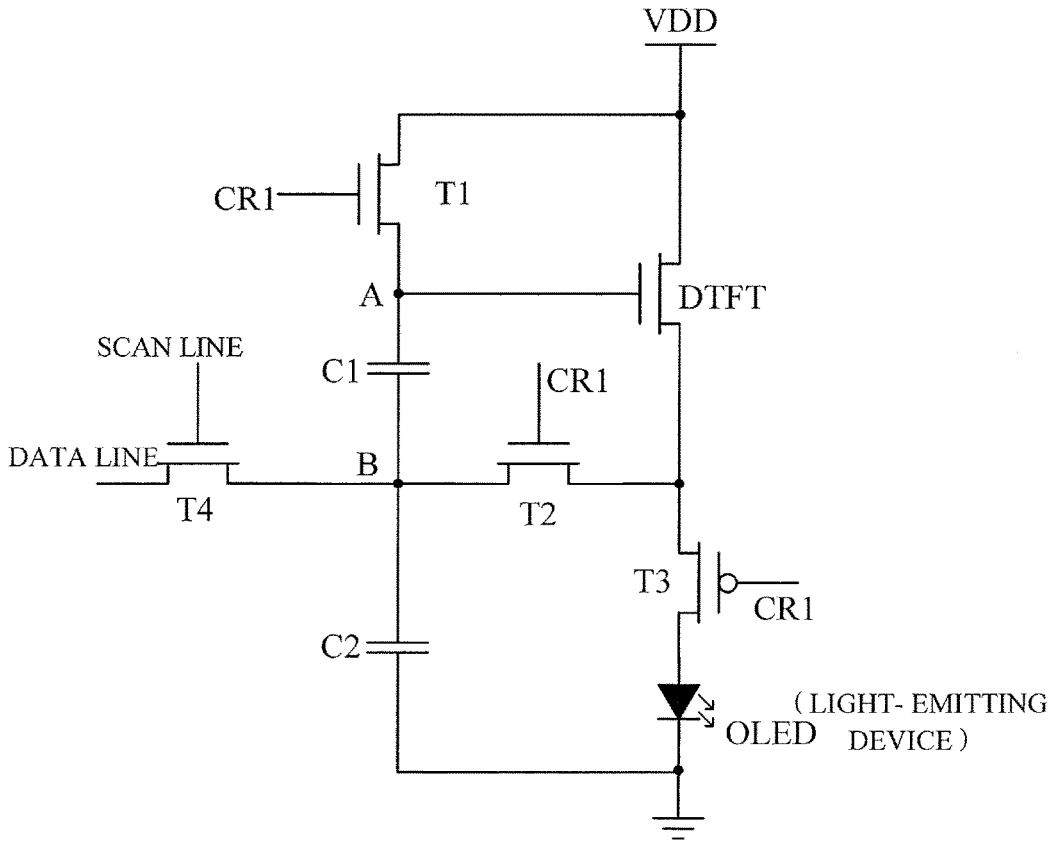
FIG. 7 is another schematic structural diagram of a pixel unit driving circuit provided in embodiments of the present disclosure.

In an example of another embodiment, the first switching transistor T1, the second switching transistor T2 are N-type Thin Film Transistors, the third switching transistor is a P-type Thin Film Transistor, and they are connected as shown in FIG. 7.

In the example shown in FIG. 7, a drain of a driving transistor DTFT is connected to a power supply VDD;

The gate of the first switching transistor T1 is connected to a control line CR1, the drain (a first terminal) of the first switching transistor T1 is connected to the power supply VDD, and the source (a second terminal) of the first switching transistor T1 is connected to the gate of the driving transistor DTFT.

The gate of the second switching transistor T2 is connected to the control line CR1, the drain of (a first terminal) of the second switching transistor T2 is connected to the source of the driving transistor DTFT, and the source (a second terminal) of the second switching transistor T2 is connected to the source of the fourth switching transistor T4.

The gate of the third switching transistor T3 is connected to the control line CR1 the drain (a first terminal) of the third switching transistor T3 is connected to one terminal of the light-emitting device OLED, and the source (a second terminal) of the third switching transistor T3 is connected to the source of the driving transistor DTFT.

The gate of the fourth switching transistor T4 is connected to a scan line, the drain of the fourth switching transistor T4 is connected to a data line, and the source of the fourth switching transistor T4 is connected to the source of the second switching transistor T2.

A terminal "A" of the first capacitor C1 is connected to the gate of the driving transistor DTFT, that is, to the source of the first switching transistor T1, and a terminal "B" of the first capacitor C1 is connected to the source of the fourth switching transistor T4, that is, to the source of the second switching transistor T2.

One terminal of the second capacitor C2 is connected to the source of the fourth switching transistor T4, that is, to the terminal "B" of the first capacitor C1 and to the source of the second switching transistor T2, and the other terminal of the second capacitor C2 is connected to the other terminal of the light-emitting device OLED and to ground.

The example shown in FIG. 7 is similar to that shown in FIG. 2, and the only difference lies in that: in the example shown in FIG. 7, the first switching transistor T1 and the second switching transistor T2 pertain to the N-type Thin Film Transistors rather than the P-type Thin Film Transistors shown in FIG. 2, and the third switching transistor T3 pertains to the P-type Thin Film Transistor rather than the N-type Thin Film Transistor shown in FIG. 2.

The example shown in FIG. 7 can be easily understood by those skilled in the art based on the above description for the example shown in FIG. 2, and thus only simple description will be given to the example shown in FIG. 7.

Figure 8:
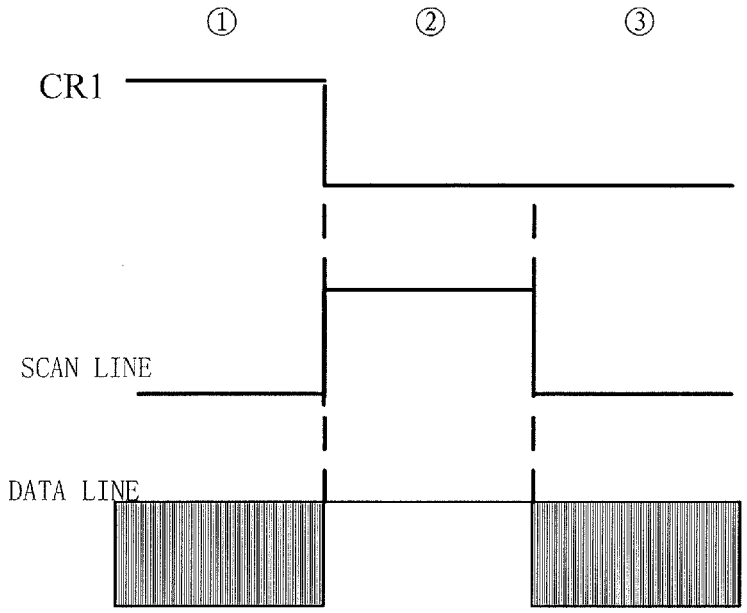
FIG. 8 is a timing sequence diagram of respective signal lines when driving the pixel unit driving circuit shown in FIG. 7.

Similar to FIG. 2, when driving OLED, the procedure for driving the pixel unit driving circuit shown in FIG. 7 can also be divided into three stages: a compensation stage, a stage in which OLED starts to emit light, and a stage in which OLED maintains to emit light. FIG. 8 is a timing sequence diagram of respective signal lines when driving the pixel unit driving circuit as shown in FIG. 7. As shown in FIG. 8, ①, ② and ③ are used to represent the compensation stage, the stage in which OLED starts to emit light, and the stage in which OLED maintains to emit light, respectively.

During the compensation stage, a high level is input from the control line CR1 and a low level is input from the scan line, which causes the first switching transistor T1 and the second switching transistor T2 turn on and the third switching transistor T3 and the fourth switching transistor T4 turn off, so that the first capacitor C1 is charged. At this time, the circuit shown in FIG. 7 actually is also equivalent to the circuit shown in FIG. 4.

During the stage in which OLED starts to emit light, that is, when the voltage across the two terminals of the first capacitor C1 is equal to the turn-on voltage of the driving transistor DTFT, a low level is input from the control line CR1 and a high level is input from the scan line, which causes the first switching transistor T1 and the second switching transistor T2 to turn off and the third switching transistor T3 and the fourth switching transistor T4 to turn on, so that the second capacitor C2 is charged and the light-emitting device OLED starts to emit light. At this time, the circuit shown in FIG. 7 actually is also equivalent to the circuit shown in FIG. 5.

During the stage in which OLED maintains to emit light, that is, after the light-emitting device OLED starts to emit light, a low level input from the control line CR1 and a low level is input from the scan line, which causes the first switching transistor T1 and the second switching transistor T2 to remain off and the third switching transistor T3 to remain on, and meanwhile the fourth switching transistor T4 to turn off, so that the light-emitting device OLED maintains to emit light. At this time, the circuit shown in FIG. 7 actually is equivalent to the circuit shown in FIG. 6.

As such, a current flowing through the light-emitting device OLED can also be calculated from the above equation (6). Since the turn-on voltage $V_{th}$ of the driving transistor DTFT does not appear in the expression of the current flowing through the light-emitting device OLED, that is, the current flowing through the light-emitting device OLED has no relation to the turn-on voltage $V_{th}$ of the driving transistor DTFT. Therefore, with the operations in the above three stages, the effect of the unevenness and drifting of the turn-on voltage $V_{th}$ of the driving transistor DTFT on the current flowing through the light-emitting device OLED can be removed, so that the evenness of the current can be improved and thus the evenness of the luminance can be achieved.

Although the pixel unit driving method of the embodiment of the present disclosure has been described in connection with the pixel unit driving circuit of the embodiment of the present disclosure, some additional description will be given for better understanding of the pixel unit driving method of the embodiment of the present disclosure.

The embodiment of the present disclosure provides a driving method for the pixel unit driving circuit described above, the driving method includes:

turning on the first switching transistor T1 and the second switching transistor T2 and meanwhile turning off the third switching transistor T3 and the fourth switching transistor T4, so that the first capacitor C1 is charged;

when the voltage across the two terminals of the first capacitor C1 is equal to the turn-on voltage of the driving transistor DTFT, turning off the first switching transistor T1 and the second switching transistor T2 and meanwhile turning on the third switching transistor T3 and the fourth switching transistor T4, so that the second capacitor C2 is charged and the light-emitting device OLED starts to emit light;

maintaining the first switching transistor T1 and the second switching transistor T2 off and the third switching transistor T3 on, and turning off the fourth switching transistor T4, so that the light-emitting device OLED maintains to emit light.

The pixel unit circuit driving method of the embodiment of the present disclosure adopts a stepwise driving manner, wherein, firstly, the turn-on voltage of the driving transistor is written into the first capacitor C1; secondly, the voltage of the data line is written into the second capacitor C2, so that the driving current of the driving transistor DTFT may have no relation to the turn-on voltage $V_{th}$ of the driving transistor DTFT, and in turn the evenness of the current flowing through the light-emitting device OLED can be improved and thus the evenness of the luminance of the light-emitting device OLED can be achieved.

Below two examples of two embodiments will be described for the pixel unit driving method of the present disclosure. It should be clear that, for the detailed description for the pixel unit driving method of the present disclosure, the description for the operational principle of the pixel unit driving circuit can be referred to.

In one embodiment of the present disclosure, in an example, in the circuit shown in FIG. 2, the driving transistor DTFT is a N-type Thin Film Transistor, the third switching transistor T3 and the fourth switching transistor T4 are N-type Thin Film Transistors, and the first switching transistor T1 and the second switching transistor T2 are P-type Thin Film Transistors; the first terminal of each switching transistor is a source, and the second terminal of each switching transistor is a drain, wherein the pixel unit driving method of the present embodiment includes:

Firstly, inputting a low level through the control line CR1 and a low level from the scan line cause the first switching transistor T1 and the second switching transistor T2 to turn on and the third switching transistor T3 and the fourth switching transistor T4 to turn off, so that the first capacitor C1 is charged and the turn-on voltage of the driving transistor DTFT is written to the first capacitor C1.

When the voltage across the two terminals of the first capacitor C1 is equal to the turn-on voltage of the driving transistor DTFT, the control line CR1 and the scan line change from the low level to a high level, which causes the first switching transistor T1 and the second switching transistor T2 to turn off, and meanwhile the third switching transistor T3 and the fourth switching transistor T4 to turn on, so that the second capacitor C2 is charged and the light-emitting device OLED starts to emit light.

When OLED starts to emit light, the control line CR1 remains at the high level and the scan line changes from the high level to the low level, which causes the first switching transistor T1 and the second switching transistor T2 to remain off and the third switching transistor T3 to remain on, and the fourth switching transistor T4 turns off, so that the light-emitting device OLED maintains to emit light.

In another embodiment of the present disclosure, in an example, in the circuit as shown in FIG. 7, the driving transistor DTFT, the first switching transistor T1, the second switching transistor T2 and the fourth switching transistor T4 are N-type Thin Film Transistors, and the third switching transistor T3 is a P-type Thin Film Transistor; the first terminal of each switching transistor is a drain, and the second terminal of each switching transistor is a source, wherein the pixel unit driving method of the present embodiment includes:

Firstly, inputting a high level through the control line CR1 and a low level through the scan line causes the first switching transistor T1 and the second switching transistor T2 to turn on and the third switching transistor T3 and the fourth switching transistor T4 to turn off, so that the first capacitor C1 is charged and the turn-on voltage of the driving transistor DTFT is written to the first capacitor C1.

When the voltage across the two terminals of the first capacitor C1 is equal to the turn-on voltage of the driving transistor DTFT, the control line CR1 changes from the high level to a low level and the scan line changes from the low level to a high level, which causes the first switching transistor T1 and the second switching transistor T2 to turn off, and the third switching transistor T3 and the fourth switching transistor T4 to turn on, so that the second capacitor C2 is charged and the light-emitting device OLED starts to emit light.

When OLED starts to emit light, the control line CR1 remains at the low level and the scan line changes from the high level to the low level, which causes the first switching transistor T1 and the second switching transistor T2 to remain off and the third switching transistor T3 to remain on, and the fourth switching transistor T4 to turn off, so that the light-emitting device OLED maintains to emit light.

According to the pixel unit driving circuit and driving method of the embodiments of the present disclosure, the pixel unit driving circuit adopts a plurality of switching transistors and a plurality of capacitors. The pixel unit driving circuit is driven in a stepwise manner by the turn-on/off of the switching transistors in cooperation with the charging of the capacitors, wherein firstly the turn-on voltage of the driving transistor DTFT is written into the first capacitor C1, and secondly the voltage of the data line is written into the second capacitor C2, so that a driving current of the driving transistor has no relation to the turn-on voltage $V_{th}$ of the driving transistor, and in turn the evenness of a current flowing through the light-emitting device OLED is guaranteed so as to achieve the evenness of the luminance of the light-emitting device OLED.

The embodiments of the present disclosure also provide a display apparatus, which may be an AMOLED display and includes the above described pixel unit driving circuit.

It should be recognized by those skilled in the art that all or part of steps of the pixel unit driving method of the embodiments of the present disclosure can be performed by hardware(s) controlled by the associated program, and the program can be stored in a computer readable storage medium which may be a read only memory, a magnetic disk or an optic disk, etc.

The above descriptions are only for illustrating the embodiments of the present disclosure, and in no way limit the scope of the present disclosure. It will be obvious that those skilled in the art may make modifications or variations without departing the spirit and scope of the present disclosure as defined by the following claims. Such variations and modifications are intended to be included within the spirit and scope of the present disclosure.

What is claimed is:

1. A pixel unit driving circuit, including:

a light-emitting device, a driving transistor, a first switching transistor, a second switching transistor, a third switching transistor, a fourth switching transistor, a first capacitor, and a second capacitor, wherein, the driving transistor includes a source, a drain and a gate, all of the first switching transistor, the second switching transistor, the third switching transistor include a gate, a first terminal and a second terminal, and the fourth switching transistor includes a source, a drain and a gate;

the drain of the driving transistor is connected to a power supply;

the gate of the first switching transistor is connected to a control line, the first terminal of the first switching transistor is connected to the power supply, and the second terminal of the first switching transistor is connected to the gate of the driving transistor;

the gate of the second switching transistor is connected to the control line, the first terminal of the second switching transistor is connected to the source of the driving transistor, and the second terminal of the second switching transistor is connected to the gate of the driving transistor via the first capacitor;

the gate of the third switching transistor is connected to the control line, the first terminal of the third switching transistor is connected to one terminal of the light-emitting device, and the second terminal of the third switching transistor is connected to the source of the driving transistor;

the gate of the fourth switching transistor is connected to a scan line, the drain of the fourth switching transistor is connected to a data line, and the source of the fourth switching transistor is directly connected to the second terminal of the second switching transistor;

a first terminal of the first capacitor is connected to the gate of the driving transistor, and a second terminal of the first capacitor is connected to the source of the fourth switching transistor; and a first terminal of the second capacitor is connected to the source of the fourth switching transistor, and a second terminal of the second capacitor is connected to the other terminal of the light-emitting device and to ground;

wherein, the first switching transistor and the second switching transistor are turned on or turned off together, and a timing sequence of the third switching transistor being turned on or turned off is completely opposite those of the first and second switching transistors, and the light-emitting device starts to emit light when a voltage at the second terminal of the first capacitor is equal to a data voltage applied to the data line.

2. The driving circuit of claim 1, wherein, the driving transistor, the third switching transistor and the fourth switching transistor are N-type Thin Film Transistors;

the first switching transistor and the second switching transistor are P-type Thin Film Transistors; and the first terminal of each switching transistor is a source and the second terminal of each switching transistor is a drain.

3. The driving circuit of claim 1, wherein, the driving transistor, the first switching transistor, the second switching transistor and the fourth switching transistor are N-type Thin Film Transistors;

the third switching transistor is a P-type Thin Film Transistor; and the first terminal of each switching transistor is a drain and the second terminal of each switching transistor is a source.

4. The driving circuit of claim 1, wherein, the light-emitting device is an Organic Light-Emitting Diode.

5. A display apparatus including the pixel unit driving circuit of claim 1.

6. A method for the pixel unit driving circuit of claim 1, including the steps of:

turning on the first switching transistor and the second switching transistor, and meanwhile turning off the third switching transistor and the fourth switching transistor, so as to charge the first capacitor;

turning off the first switching transistor and the second switching transistor, and meanwhile turning on the third switching transistor and the fourth switching transistor, so as to make the light-emitting device start to emit light, when a voltage between the two terminals of the first capacitor is equal to the turn-on voltage of the driving transistor; and maintaining the first switching transistor and the second switching transistor being off and the third switching transistor being on, and turning off the fourth switching transistor, so as to maintain the light-emitting device in light-emitting.

7. The method of claim 6, wherein, the driving transistor, the third switching transistor and the fourth switching transistor are N-type Thin Film Transistors;

the first switching transistor and the second switching transistor are P-type Thin Film Transistors; and the first terminal of each switching transistor is a source and the second terminal of each switching transistor is a drain, wherein, the step of turning on the first switching transistor and the second switching transistor and meanwhile turning off the third switching transistor and the fourth switching transistor includes inputting a low level through the control line and a low level through the scan line;

the step of turning off the first switching transistor and the second switching transistor and meanwhile turning on the third switching transistor and the fourth switching transistor includes inputting a high level through the control line and a high level through the scan line; and the step of maintaining the first switching transistor and the second switching transistor being off and the third switching transistor being on and turning off the fourth switching transistor includes inputting a high level through the control line and a low level through the scan line.

8. The method of claim 6, wherein, the driving transistor, the first switching transistor, the second switching transistor and the fourth switching transistor are N-type Thin Film Transistors;

the third switching transistor is a P-type Thin Film Transistor; and the first terminal of each switching transistor is a drain and the second terminal of each switching transistor is a source;

wherein, the step of turning on the first switching transistor and the second switching transistor and meanwhile turning off the third switching transistor and the fourth switching transistor includes inputting a high level through the control line and a low level through the scan line;

the step of turning off the first switching transistor and the second switching transistor and meanwhile turning on the third switching transistor and the fourth switching transistor includes inputting a low level through the control line and a high level through the scan line; and the step of maintaining the first switching transistor and the second switching transistor being off and the third switching transistor being on and turning off the fourth switching transistor includes inputting a low level through the control line and a low level through the scan line.

9. The method of claim 6, wherein, the light-emitting device is an Organic Light-Emitting Diode.

* * * * *